US008362965B2

(12) United States Patent
Henderson

(10) Patent No.: US 8,362,965 B2
(45) Date of Patent: Jan. 29, 2013

(54) LOW COST ELECTRONICALLY SCANNED ARRAY ANTENNA

(75) Inventor: William H. Henderson, Redondo Beach, CA (US)

(73) Assignee: ThinKom Solutions, Inc., Torrance, CA (US)

( * ) Notice: Subject to any disclaimer, the term of this patent is extended or adjusted under 35 U.S.C. 154(b) by 926 days.

(21) Appl. No.: 12/350,341

(22) Filed: Jan. 8, 2009

(65) Prior Publication Data

US 2010/0171674 A1 Jul. 8, 2010

(51) Int. Cl.
*H01Q 13/00* (2006.01)

(52) U.S. Cl. ..... 343/778; 343/771; 343/853

(58) Field of Classification Search ..... 343/771, 343/772, 778, 853
See application file for complete search history.

(56) References Cited

U.S. PATENT DOCUMENTS

| | | | | |
|---|---|---|---|---|
| 2,959,783 | A | 11/1960 | Harley | |
| 3,274,601 | A | 9/1966 | Blass | |
| 3,276,023 | A | 9/1966 | Dorne et al. | |
| 3,478,284 | A | 11/1969 | Blass | |
| 3,569,974 | A | 3/1971 | McLeod, Jr. | |
| 3,629,739 | A | 12/1971 | Barber et al. | |
| 3,708,796 | A | 1/1973 | Gilbert | |
| 3,919,670 | A | 11/1975 | Klein | |
| 3,978,484 | A | 8/1976 | Collier | |
| 4,090,204 | A | 5/1978 | Farhat | |
| 4,297,708 | A | 10/1981 | Vidal | |
| 4,320,404 | A | 3/1982 | Chekroun | |
| 4,447,815 | A | 5/1984 | Chekroun et al. | |
| 4,568,893 | A | 2/1986 | Sharma | |
| 5,148,142 | A | 9/1992 | Buckshaw et al. | |
| 5,274,839 | A * | 12/1993 | Kularajah et al. | 455/12.1 |
| 5,729,239 | A | 3/1998 | Rao | |
| 5,923,289 | A * | 7/1999 | Buer et al. | 342/373 |
| 6,028,552 | A * | 2/2000 | Shuguang | 342/372 |
| 6,037,910 | A * | 3/2000 | Solbach et al. | 343/776 |
| 6,538,621 | B1 | 3/2003 | Sievenpiper et al. | |
| 6,999,040 | B2 | 2/2006 | Robertson, Jr. et al. | |
| 7,038,558 | B2 | 5/2006 | Higgins | |
| 7,106,265 | B2 | 9/2006 | Robertson et al. | |

OTHER PUBLICATIONS

Microwave Encyclopedia, http://www.microwaves101.com, "Directional couplers", pp. 1-5.

Lam et al., "Millimeter-Wave Diode-Grid Phase Shifters", IEEE Transactions on Microwave Theory and Technique, vol. 36, No. 5, 1988, pp. 902-907.

Boccia et al., "Experimental Investigation of a Varactor Loaded Reflectarray Antenna", IEEE MTT-S International Microwave Symposium Digest, vol. 1, Jun. 2002, pp. 69-71.

Parnes et al., "Design of a Steerable Reflect-array Antenna with Semiconductor Tunable Varactor Diodes", Progress in Electromagnetics Research Symposium, 2006, pp. 130-132.

* cited by examiner

*Primary Examiner* — Tan Ho
(74) *Attorney, Agent, or Firm* — Renner, Otto, Boisselle & Sklar, LLP

(57) ABSTRACT

An electronically scanned array (ESA) antenna includes a main line along which an electromagnetic traveling wave may propagate and a plurality of array elements distributed along the main line. Each of the plurality of array elements includes a branch line; an antenna radiator at one end of the branch line; an electronically controllable reflection phase shifter at the opposite end of the branch line; a directional coupler which couples energy between the main line and the branch line.

39 Claims, 6 Drawing Sheets

LOW COST ELECTRONICALLY SCANNED ARRAY ANTENNA

TECHNICAL FIELD OF THE INVENTION

The present invention relates generally to antennas, and more particularly to a low cost electronically scanned array antenna.

DESCRIPTION OF THE RELATED ART

Electronically scanned array (ESA) antennas represent a major leap forward in antenna technology. ESA antennas include a large number of individual antenna elements, phased in unison, to create a single antenna beam that is electronically steerable. This beam is steered by adjusting the phase of the RF signal at each of the individual antenna elements. ESA antennas are particularly suited for use in the microwave/millimeter wave bands and have many advantages over other antenna concepts, including fast, reliable beam steering, a compact volume profile, and graceful degradation with device failures.

Although ESA antennas offer tremendous benefits for multifunction radar systems and the like, their very high cost has prevented widespread use of this technology in all but the most high-end military systems. To date, ESA antennas usually have been constructed with a considerable amount of electronics behind every radiating element. Such electronics typically include a phase shifter, a low noise amplifier, a medium or high power amplifier, a circulator (or T/R switch), a limiter, and a digital control chip (typically an ASIC). The cost of both the electronic components themselves and the costs associated with packaging and thermal management in the small space dictated by the element spacing are substantial. In fact, the main cost driver of the complete antenna system is the front end electronics and its associated support structure and cooling system. The expensive nature of this type of antenna architecture has been an impediment to aggressively deploying it in radar and communication systems.

One option for lowering the cost of such ESA antennas has been to use a passive ESA approach where multiple radiators are fed by a single electronics (T/R) module via a manifold. The T/R module contains the electronic components listed above, except for the phase shifter. It is still necessary to have a phase shifter behind every radiator. However there is a significant cost benefit because it reduces the quantities of most of the expensive components and simplifies the packaging issues. In this architecture, there can be as few as just one T/R module for the entire antenna or it is possible to use many modules, with each one dedicated to some fraction of the total area.

A major impediment to the widespread use of such passive ESA antennas is the requirement that both the manifold and the phase shifters have very low loss. Low-loss/low-cost manifolds can be realized with waveguide, however integrating a cost effective phase shifter technology with waveguide is somewhat problematic. While low-loss phase shifter can be implemented in waveguide using ferrites, such phase shifters are costly, heavy and their control electronics require considerable power. Integrating standard MMIC phase shifters with waveguide structures is difficult, since MMIC phase shifters are generally designed to interface with microstrip or CPW, and transitions to waveguide add significant cost and loss. Also, MMIC phase shifters, such as pin-diode or GaAs FET devices, typically have 4 to 5 dB of loss at X-Band. The Radant lens antenna represents an approach to realizing phase shifters by integrating low cost solid state devices directly into a (over-moded) waveguide structure. However the Radant lens requires many cascaded stages in order to realize the necessary phase tuning range; this drives up both phase shifter cost and the complexity of routing the necessary control signals.

In view of the aforementioned shortcomings associated with conventional ESA antenna techniques, there is a strong need for a passive ESA architecture that provides the desired advantages of high beam agility, while overcoming the above-described problems associated with cost, weight, ease of integration, etc., which are usually associated with passive ESA antennas.

SUMMARY

According to one aspect of the invention, there is provided an electronically scanned array (ESA) antenna, comprising: a main line along which an electromagnetic traveling wave may propagate; and a plurality of array elements distributed along the main line, each of the plurality of array elements comprising: a branch line; a directional coupler having a first port in the main line, a second port in the main line, a third port in the branch line, and a fourth port in the branch line; a reflective termination at an end of the branch line closest to the third port of the directional coupler; an electronically controlled phase shifter between the third port of the directional coupler and the reflective termination; and an antenna radiator at the end of the branch line closest to the fourth port of the directional coupler.

According to one aspect of the invention, the directional coupler in each array element couples transmit electromagnetic energy from the main line to the branch line via the directional coupler's $S_{31}$ S-matrix element, wherein the first through fourth ports of the directional coupler are specified by subscript values 1 through 4 of the S-matrix, respectively.

According to one aspect of the invention, the electromagnetic energy coupled to each branch line is reflected by the phase shifter and/or reflective termination.

According to one aspect of the invention, a majority of electromagnetic energy reflected by the phase shifter and/or reflective termination propagates through the branch line, through the directional coupler to the radiator.

According to one aspect of the invention, a majority of electromagnetic energy received by each radiator propagates through a branch past the directional coupler and is reflected by the phase shifter and/or reflective termination.

According to one aspect of the invention, a majority of the received electromagnetic energy reflected by the phase shifter and/or reflective termination in each branch line is coupled via the directional coupler's $S_{13}$ element to the main line.

According to one aspect of the invention, the $S_{31}$ element of the S-matrix of each directional coupler preferably satisfies $|S_{31}| \leqq 0.3$, where first through fourth ports of the directional coupler are specified by subscript values 1 through 4 of the S-matrix, respectively.

According to one aspect of the invention, the ESA antenna further includes a controller, wherein a radiation pattern emitted by the antenna is controllable by the controller via the phase shifters.

According to one aspect of the invention, a magnitude of coupling provided by each of the directional couplers is varied along the main line.

According to one aspect of the invention, the phase shifter in each array element comprises a varactor diode.

According to one aspect of the invention, the reflective termination is a short, and the varactor is a shunt element in the branch line.

According to one aspect of the invention, the phase shifters in each array element comprises a plurality of varactor diodes each shunted across a branch line.

According to one aspect of the invention, the mainline and the branch line in each array element are waveguides.

According to one aspect of the invention, the branch line in each array element is a ridged waveguide.

According to one aspect of the invention, the directional coupler in each array element is a cross guide coupler.

According to one aspect of the invention, the antenna radiator in each array element comprises an open-ended waveguide or flared notch structure.

According to one aspect of the invention, a transmission medium for the mainline and branch lines is any one of a waveguide, microstrip, stripline, coplanar waveguide, slotline, or a combination thereof.

According to one aspect of the invention, the ESA antenna includes a plurality of main lines each with a corresponding plurality of the array elements, arranged to form a two-dimensional array.

According to one aspect of the invention, the antenna is constructed in a quasi-monolithic manner in which individual parts comprise structures for a plurality of array elements.

According to one aspect of the invention, the antenna has a quasi-monolithic, multi-layer construction including a first layer defining the plurality of radiators and upper halves of the plurality of mainlines, directional couplers, and branch lines, a second layer comprising lower halves of the plurality of mainlines, directional couplers, and branch lines, and a third layer comprising an array of waveguide offset shorts that terminate the plurality of branch lines.

According to one aspect of the invention, one or more circuit boards are sandwiched between the second and third layers so as to realize phase shifters within each branch line.

According to one aspect of the invention, the one or more circuit boards are flexible circuit boards.

According to one aspect of the invention, the ESA antenna further includes one or more spacer layers between the second and third layers.

According to one aspect of the invention, each spacer layer comprises an array of waveguide shims.

According to one aspect of the invention, the circuit board is at least partially wrapped around the third layer.

According to one aspect of the invention, the phase shifters comprise analog variable capacitance devices.

According to one aspect of the invention, the analog variable capacitance devices comprise at least one of MEMS varactors, varactor diodes or voltage variable dielectric based capacitors.

According to one aspect of the invention, the phase shifters comprise MEMS-based or semiconductor-based switches.

According to one aspect of the invention, the phase shifters are ferrite-based phase shifters.

According to one aspect of the invention, the phase shifters comprise voltage variable dielectric materials in either film or bulk form.

According to one aspect of the invention, lengths and/or dispersion of the branch lines are variable so as to alter the instantaneous bandwidth of the antenna.

According to one aspect of the invention, the ESA antenna further includes two arrays of main lines each with a corresponding plurality of the array elements, said main lines arranged such that array elements of the respective main lines are interleaved to form two co-located two-dimensional arrays.

According to one aspect of the invention, the radiator elements of the two arrays have orthogonal polarizations.

According to one aspect of the invention, the ESA antenna further includes two main lines each with a corresponding plurality of branch lines and phase shifters, said main lines arranged such that branch lines of the respective main lines are interleaved to form two co-located two-dimensional arrays.

According to one aspect of the invention, neighboring pairs of elements of the two arrays share common dual polarization radiators.

According to one aspect of the invention, neighboring pairs of elements of the two arrays share common dual band radiators.

According to one aspect of the invention, the two arrays are configured to operate at distinct frequency bands.

According to one aspect of the invention, there is provided a waveguide-based antenna, comprising: a quasi-monolithic, multi-layer structure; and a plurality of mainlines, each mainline including a plurality of crossguide couplers and a plurality of branch lines.

According to one aspect of the invention, the branch lines of the waveguide-based antenna are interleaved.

According to one aspect of the invention, the wave-guide based antenna further includes phase shifters in a propagation path between each crossed guide coupler and radiator.

According to one aspect of the invention, the waveguide-based antenna further includes at least one additional coupler in the propagation path.

According to one aspect of the invention, the antenna comprises injection molded or cast parts.

According to one aspect of the invention, the ESA and/or waveguide-based antenna further include at least one of a flared notch, open ended waveguide or patch radiator structure.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

It should be emphasized that the term "comprises/comprising" when used in this specification is taken to specify the presence of stated features, integers, steps or components but does not preclude the presence or addition of one or more other features, integers, steps, components or groups thereof.

DETAILED DESCRIPTION OF EMBODIMENTS

The present invention will now be described with reference to the drawings, wherein like elements are referred to with like reference labels throughout.

Figure 1:
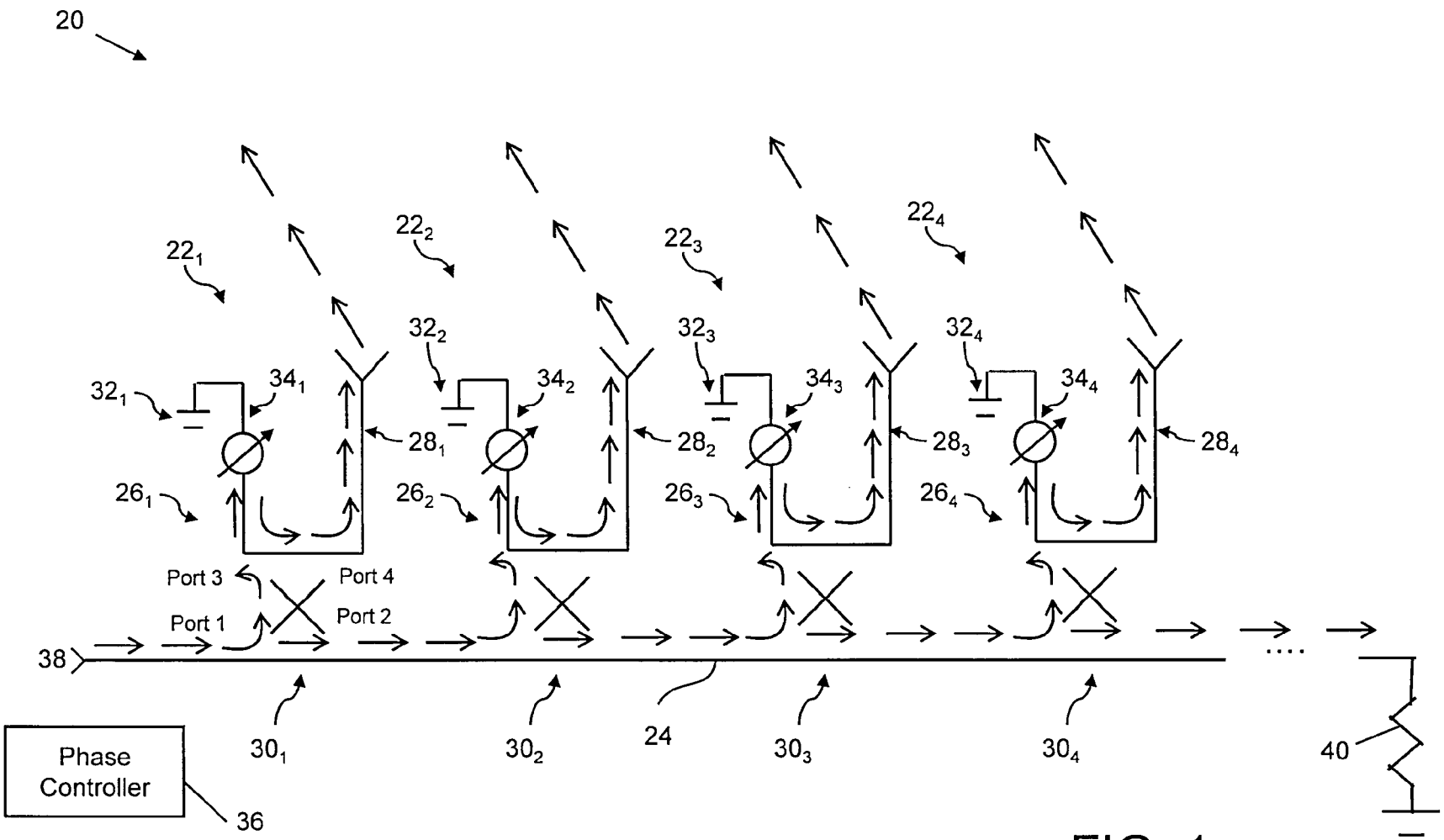
FIG. 1 is a schematic illustration of an ESA antenna in accordance with an embodiment of the present invention.

FIG. 1 illustrates the basic structure and operation of a passive ESA antenna 20 in accordance with an exemplary embodiment of the present invention. The antenna 20 includes multiple array elements 22 (e.g., $\mathbf{22}_1$, $\mathbf{22}_2$, $\mathbf{22}_3$, $\mathbf{22}_4$, . . . , etc.). The particular number of array elements 22 can be any number selected by design. Moreover, although the array elements 22 are arranged in a linear array as shown in FIG. 1, it will be appreciated that other configurations are possible without departing from the scope of the invention. For example, the array elements 22 may be arranged in a two-dimensional array as discussed below in relation to FIG. 3.

The antenna 20 includes a main line 24 along which the array elements 22 are distributed. Electromagnetic traveling waves propagate along the main line 24 and are coupled to each of the array elements 22. By controlling the phase of the signal at each of the array elements 22, it is possible to control the direction of the beam transmitted/received from the antenna 20 as is explained more fully below.

The array elements 22 each include a branch line 26, and an antenna radiator 28. In addition, the array elements 22 each include a directional coupler 30. Each of the directional couplers 30 includes a first port which is in the main line 24, a second port (port 2) which is in the main line 24, a third port (port 3) which is in the branch line 26, and a fourth port (port 4) which is in the branch line 26. The radiator 28 is connected to the end of the branch line that is closer to the fourth port of the directional coupler. Still further, each array element 22 includes a reflective termination 32 at an end of the branch line 26 that is closer to the third port of the directional coupler 30, and an electronically controlled phase shifter 34 within the branch line 26. A system phase controller 36 provides phase control signals to the phase shifters 34 in order to steer the beam.

The antenna 20 will now be described for the case of operation in transmit mode. However, it will be appreciated that the antenna 20 works equally well in receive mode. In the transmit mode, radio frequency (RF) energy is input to the main line 24 by way of a feed 38 located at one end of the main line 24 (the other end of the main line 24 being terminated by a matching load 40).

The antenna 20 is a traveling wave structure in which energy propagating along the main line 24 (e.g., realized as a rectangular waveguide) is coupled to the series of branch lines 26 (e.g., realized as a ridged waveguide) via the array of directional couplers 30. The fraction of energy coupled from the main line 24 to a given branch line 26 is determined by the $S_{31}$ value of the directional coupler's S-matrix (see specification of port numbers above and in FIG. 1). The energy coupled to a given branch line 26 travels to the corresponding phase shifter 34 and then a majority of the energy is reflected back towards the directional coupler 30 via the reflective termination 32.

Figure 6:
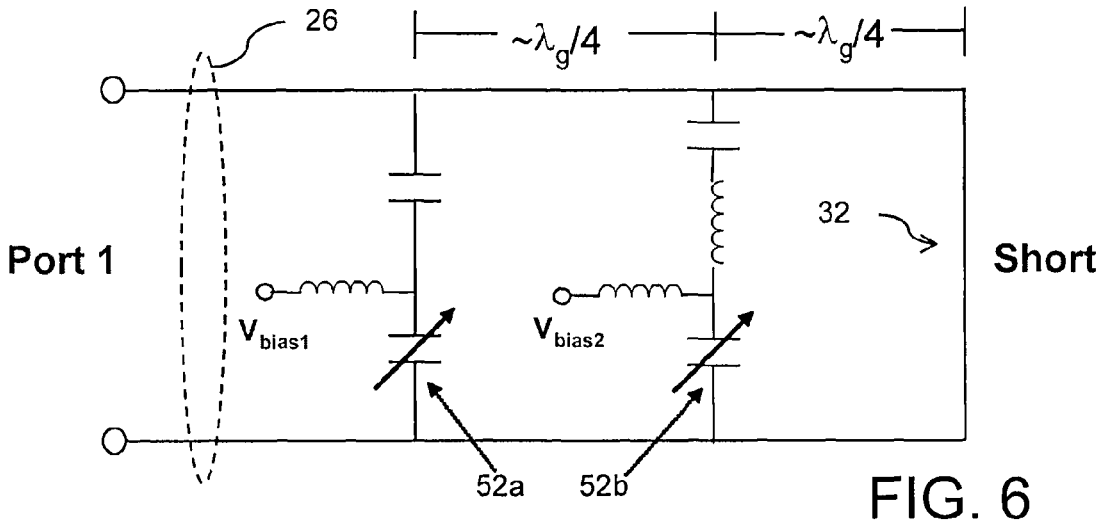
FIG. 6 is a circuit model of a two-stage reflective phase shifter incorporated in an ESA antenna in accordance with an embodiment of the present invention.

In an exemplary embodiment, the reflective termination 32 may simply be a short, and the phase shifter 34 may incorporate a varactor diode as a shunt element in the waveguide as discussed in more detail in reference to FIG. 6.

Most of the energy reflected back towards the directional coupler 30 is coupled via the $S_{43}$ element in the coupler's S-matrix to the corresponding radiator 28 (e.g., the majority of energy reflected by the phase shifter and/or reflective termination propagates through the branch line, and through the directional coupler to the radiator). Thus, the RF energy having been phase shifted by the corresponding phase shifter 34 is then transmitted through the radiator 28. By setting the reflection phase of the phase shifters 34 in each of the array elements 22, a desired phase gradient along the array can be obtained which will steer the beam radiated by the antenna 20 in the desired direction.

Some energy reflected back towards the directional coupler 30 by the reflective termination 32 will be coupled back into the main line 24 via the $S_{13}$ S-matrix element, which can be undesirable. Accordingly, the directional couplers 30 preferably are designed so as to have an $S_{31}$ S-matrix element which is reasonably small. Preferably the $S_{31}$ element is 0.3 or less, but there is no strict upper limit. When the $S_{31}$ element is 0.3 or less, $|S_{43}|$ will be much greater than $|S_{31}|$. For example, if $|S_{31}|=0.3$, $|S_{43}|$ will be ~0.95 if all of the ports have high return loss. As a result, the first order approximation (neglecting mutual coupling among the elements 22) for the energy coupled to the radiator 28 on a given branch line 26 is much larger than the energy coupled back into the main line 24 (by a factor of about 10 for the case of $|S_{31}|=0.3$).

Another consideration to be taken into account when designing the antenna 20 is that at certain scan angles, the mutual coupling among the array elements 22 may become severe if the RF signals coupled back into the main line 24 by each branch line 26 are in phase with each other. In such cases, most of the total energy in the array elements 22 is coupled back into the main line 24 rather than to the radiators 28, thereby greatly reducing the gain and increasing the VSWR. These cases occur when the following equation is satisfied: $K_0 \sin(\Theta)=+/-K_{mainline}$, where $K_0$ is the propagation constant in free space ($=2*\pi/\lambda$ (free space wavelength)), $\Theta$ is the steering angle, and $K_{mainline}$ is the propagation constant in the main line 24.

By designing with an appropriate choice of $K_{mainline}$, the angles at which this occurs can be outside the desired operating range. For example, if $K_{mainline}=0.95\ K_0$, the equation is satisfied at $\Theta=+/-72°$. When this equation is not satisfied, the effect of mutual coupling is highly suppressed. It is noted that the value of $K_{mainline}$ can be greater than $K_0$ if the main line 24 is either (fully or partially) dielectrically loaded or if appropriate reactive features (e.g. corrugations) are added to the main line 24. With $K_{mainline}>K_0$, full hemispherical scan volume is possible in principle. A more rigorous analysis could use the equation: $K_0 d \sin(\Theta)=+/-K_{mainline} d+2n\pi$, where d is the spacing between elements 22 and n is any integer. If $K_{mainline}\leqq K_0$ and $d\leqq\lambda/2$, only n=0 solutions exist with real values of $\Theta$ and the equation given above is sufficient. For some values of $K_{mainline}$ and d (e.g. $K_{mainline}=1.05\ K_0$ and $d=0.45\lambda$), there are no solutions with real $\Theta$ for any values of n. In such cases, full hemispherical scan is possible.

Figure 2:
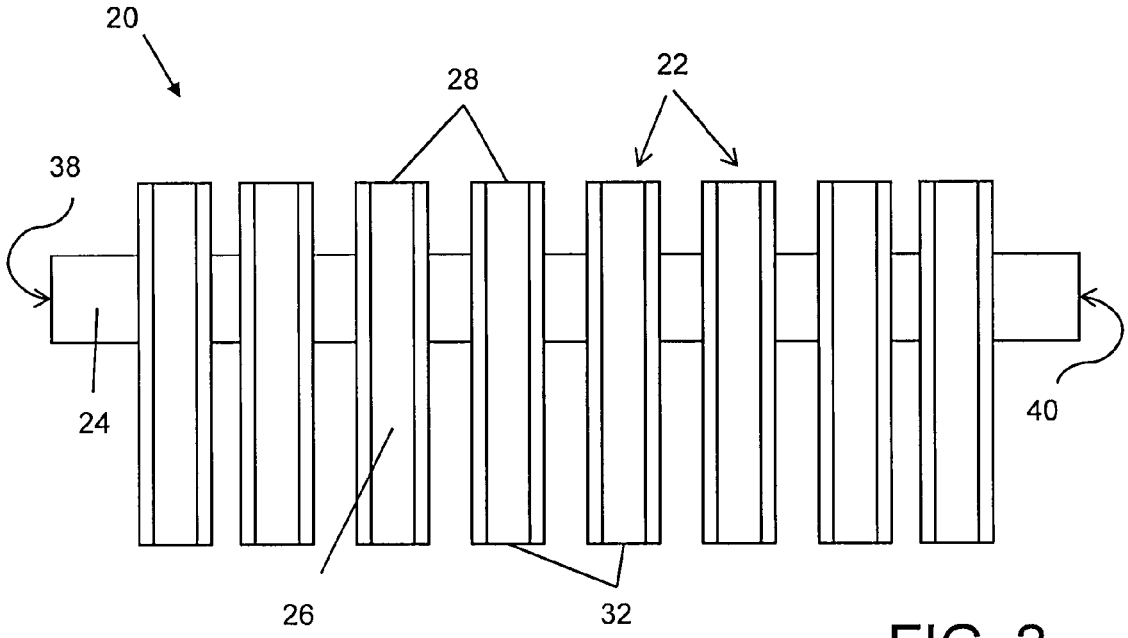
FIG. 2 is a side view of an ESA antenna in accordance with an embodiment of the present invention.

Referring to FIG. 2, the antenna 20 is shown in accordance with an eight element linear array embodiment. The main line 24 is a rectangular waveguide including the feed port 38 at one end and load 40 at the other end. Eight array elements 22 are spaced apart along the main line 24. The array elements 22 are embodied in ridged waveguide each arranged perpendicular to the main line 24 with cross guide coupling holes therebetween (serving as the directional coupler 30 as discussed below with respect to FIG. 4). In the transmit mode, energy from the main line 24 is coupled into each array element 22. The energy is directed towards the end including the phase shifter and reflective termination 32, and is reflected back towards and out of the radiator 28. In the exemplary embodiment, the radiators 28 may simply consist of an open end of the ridged waveguide. However, the present invention is not limited to such a configuration, and can utilize some other type of radiator element as will be appreciated (e.g., flared notch, patch, etc.). In the receive mode, the opposite occurs whereby energy is received by the radiators 28, reflected by the reflective terminations 32, and coupled into the main line 24 as will be appreciated (e.g., a majority of electromagnetic energy received by each radiator propagates through the branch line past the directional coupler and is reflected by the phase shifter and/or reflective termination).

The amount of coupling between the directional couplers 30 and main line 24 in each of the array elements 22 may be identical. However, this does not provide optimal sidelobe performance. Accordingly, a design may include varying the coupling of the elements 22 along 10 the main line 24 in order to obtain a tapered distribution with better sidelobe performance. Obtaining good sidelobe performance can also be facilitated by using two sets of mainlines that are fed from the center of the overall structure; this approach naturally gives a symmetric tapered distribution with more energy in the center of the array. It is noted that the lengths and/or dispersion of the branch lines can be varied in a systematic manner so as to increase the instantaneous bandwidth of the antenna.

Figure 3:
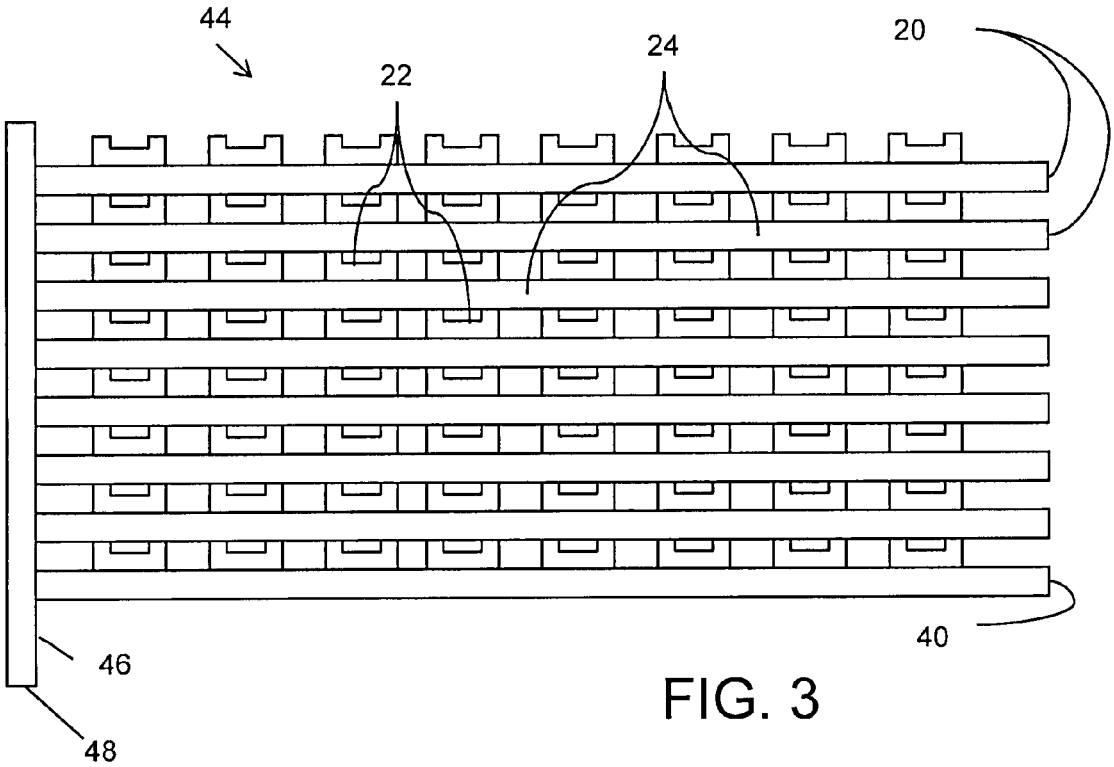
FIG. 3 is a top view of a plurality of the antennas as shown in FIG. 2 combined to form a two-dimensional ESA antenna in accordance with an embodiment of the present invention.

FIG. 3 illustrates an antenna 44 in accordance with an eight by eight two-dimensional array embodiment. In this particular embodiment, a primary feed line 46 having a primary feed port 48 is provided. The antenna 44 includes multiple antennas 20 of FIG. 2 as subarrays arranged in parallel. Specifically, the feed 38 of each of the antennas 20 is fed by the primary feed line 46. Again, the phase shifters 34 of the respective elements 22 are controllable electrically by the phase controller 36. Thus, the beam of the antenna 44 may be steered in two dimensions as will be appreciated. Also, it is noted that if a phase shifter 34 should fail, the effect on the aperture distribution is mainly localized. Therefore, the antenna of the present invention is advantageous in that the performance degrades gracefully should phase shifter failures occur.

Figure 4:
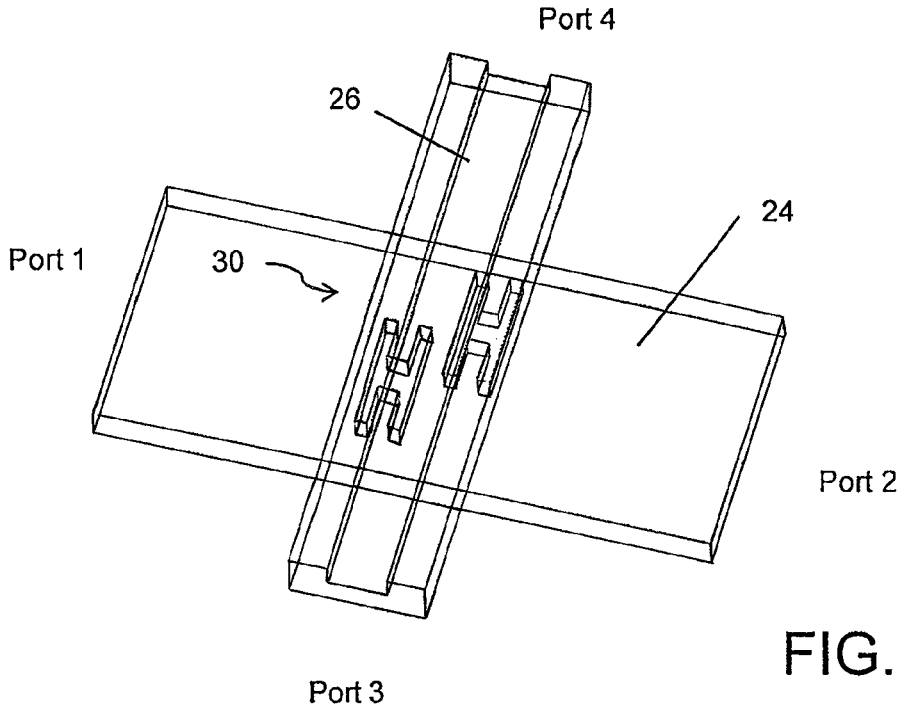
FIG. 4 is a schematic illustration of a directional coupler for coupling a main line and branch line within an ESA antenna according to an embodiment of the present invention.

FIG. 4 illustrates an exemplary embodiment of the directional coupler 30 in each of the elements 22. The main line 24 is a rectangular waveguide with a cutoff frequency that is far below the intended operating frequency range. The branch line 26 is a ridged waveguide. The coupler 30 is a crossguide coupler (i.e., the propagation directions in the main line 24 and the branch lines 26 are orthogonal). Since the branch lines 26 are ridged waveguides, two logical choices for the radiator 28 design are the aforementioned flared notch and open ended ridged waveguide. Both of these radiators provide linear polarization. An external polarizer can be used if circular polarization is desired.

Figure 5:
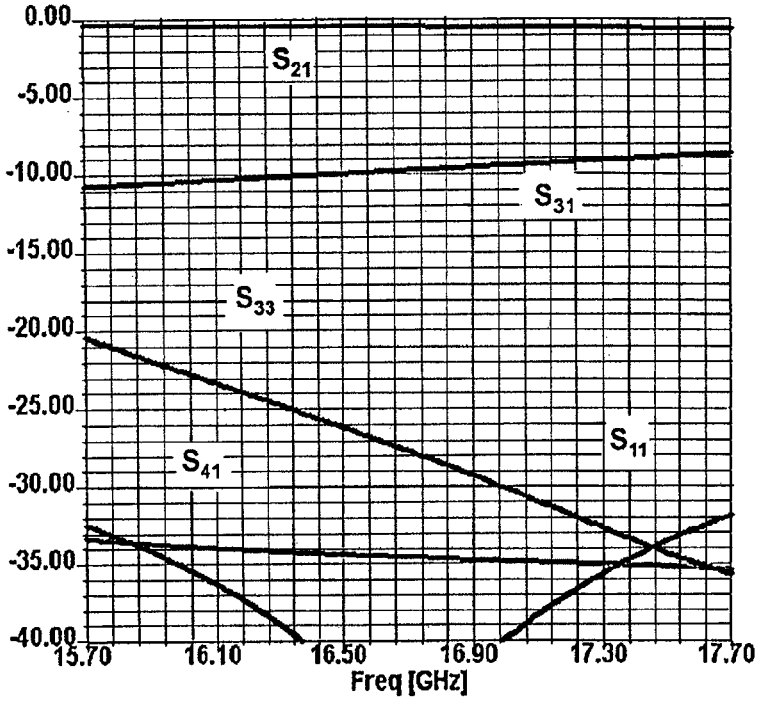
FIG. 5 represents simulated S-matrix elements for the directional coupler of FIG. 4 in accordance with an embodiment of the present invention.

An exemplary design for the directional coupler 30 was created by the inventor. This cross-guides coupler design was formed for the upper end of Ku-Band and is similar in principle to a Moreno coupler. The shape of the coupling slots, however, were modified in order to work with the combination of a rectangular and a ridged waveguide (Moreno couplers generally only use rectangular waveguides). The design of the coupler 30, along with its simulation results, is shown in FIGS. 4 and 5, respectively. The coupler 30 uses a pair of coupling holes, each of which has a tall, narrow double ridged waveguide cross section (roughly shaped like a capital letter "H"). As is shown, large coupling (relative to typical cross guide couplers) can be achieved ($|S31| \sim -10$ dB), while still maintaining good return loss on all ports 1 through 4 over a wide range of frequencies. While FIGS. 4 and 5 illustrate an exemplary directional coupler 30, it will be appreciated that types and configurations of directional couplers may be used without departing from the intended scope of the invention. Moreover, while the invention is described herein primarily in the context of a waveguide transmission medium, other mediums are equally suitable, such as microstrip, stripline, coplanar waveguide, slotline, etc., or a combination thereof.

Figure 7:
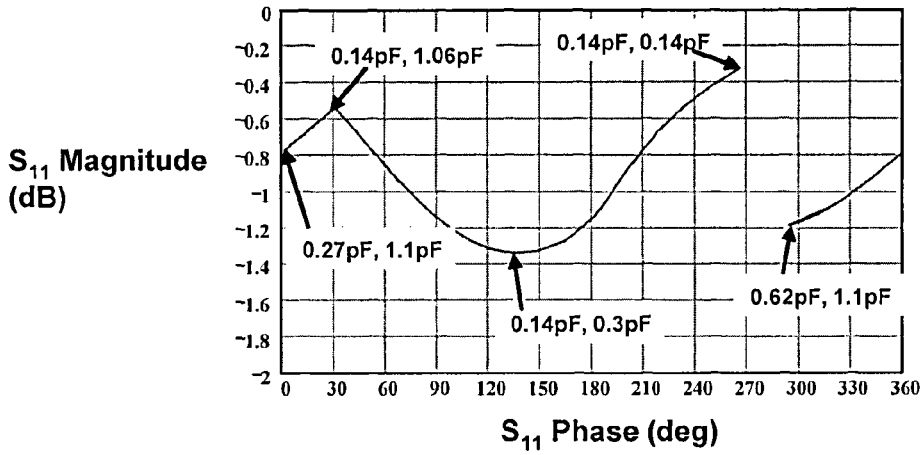
FIG. 7 represents a simulated loss to phase comparison for the reflection phase shifter of FIG. 6.

FIGS. 6 and 7 present a circuit model of a phase shifter 34 for use in the array elements 22 in accordance with an exemplary embodiment. As will be appreciated, the antenna according to the present invention can be implemented using any of a number of different phase shifter architectures. A simple low cost approach to the phase shifter 34 is to embed the necessary circuits directly in the branch line waveguides 26. This gives the added benefit of reducing the dissipative loss relative to that of MMIC phase shifters where the propagation medium is microstrip. Varactor diodes enable very low cost, easy to manufacture phase shifters. Varactor diodes are p-n junction diodes, designed with very low parasitic reactances, which provide a capacitance that is tuneable by adjusting the value of an applied (reverse) DC bias voltage. Although it is preferable to fabricate such varactor diodes from GaAs since low loss is desired, their simplicity and small size enable their cost to be minimal. Low loss varactor diode based phase shifters have been demonstrated previously many times at microwave and millimeter wave frequencies in waveguide.

Reflection phase shifters can be made with a single varactor diode, typically shunted across the transmission medium (e.g., the branch line 26) about ¼ of a wavelength away from a short (e.g., the reflection terminal 32). Using such a design approach, the varactors (and the necessary metallization that couples the electromagnetic fields to the varactor in an appropriate manner) for the array elements 22 in a two dimensional array can be implemented on a single, easy to manufacture, circuit board. The control (DC bias) lines can be routed to the back of the board, where control circuits are located.

Although each phase shifter 34 may include simply a single varactor, it is proposed that better performance can be obtained using a multiple (e.g., two) stage design, with one varactor per stage. Also, it is noted that two varactor devices per phase shifter is far less than what is necessary for transmission phase shifters in accordance with conventional ESA principles, where impedance matching considerations severely limit the amount of phase shift that can be obtained from a single device. For example, a Radant Lens antenna typically uses transmission phase shifters with 13 cascaded stages (containing capacitors that can be switched in or out using PIN diodes), just to provide one dimensional beam steering. The present embodiment uses only two stages and provides full two-dimensional beam steering.

A circuit model design of a two-stage reflection phase shifter (incorporating both the phase shifter 34 and reflective termination 32) is shown in FIG. 6. In this particular example, the phase shifter is designed for operation in the X-Band. The parameters given for the varactors 52*a* and 52*b* are that of a commercially available, off-the-shelf GaAs device. The series resistance value (2.8 Ohms) was inferred from the manufacturer's stated Q value of 3000 (min). Strictly speaking, the 2.8 Ohm resistance value is for the case in which a −4 Volt DC bias voltage is applied. (It is the industry standard to specify a varactor's Q value only at this voltage.) Over most of the range of bias voltages, the series resistance should actually be significantly less than it is at −4 Volts. Therefore loss estimates based on this value are somewhat pessimistic. The capacitances of the two varactors are controlled independently (with separate bias voltages) via the controller 36 (FIG. 1), so there are typically many combinations of values of the varactors' capacitances that can be used to obtain a given reflection phase. The graph in FIG. 7 shows the circuit's loss as a function of reflection phase. At each phase value, the combination of varactor capacitance values that gives the lowest loss is used. The loss averaged over all reflection phase values is about 0.9 dB, and the circuit provides 330 degrees of phase tuning. There is a tradeoff between phase tuning range and loss. In practice, the phase error that will be present on some fraction of the radiators due to the fact that the phase shifters 34 don't provide 360 degrees of tuning will have a negligible performance impact.

Varactor diodes have a number of additional desirable characteristics for ESA applications. Their response time is determined by the RC time constant set by the source impedance of the biasing circuit and the capacitance of the diode, which is typically 1 pF or less. Thus with a 50 Ohm source impedance, their response time is about 0.05 nanoseconds. In practice the beam steering time will be limited by the speed of the digital control circuitry. Another advantage is that since varactor diodes are operated in reverse bias, they draw virtually no DC current. The only current they draw from the bias circuit is the negligible transient required to charge their very low capacitance. This means that they require essentially zero power to be used as phase shifters. This is in sharp contrast to PIN diodes, which are operated in forward bias and require considerable current to actuate.

Figure 8:
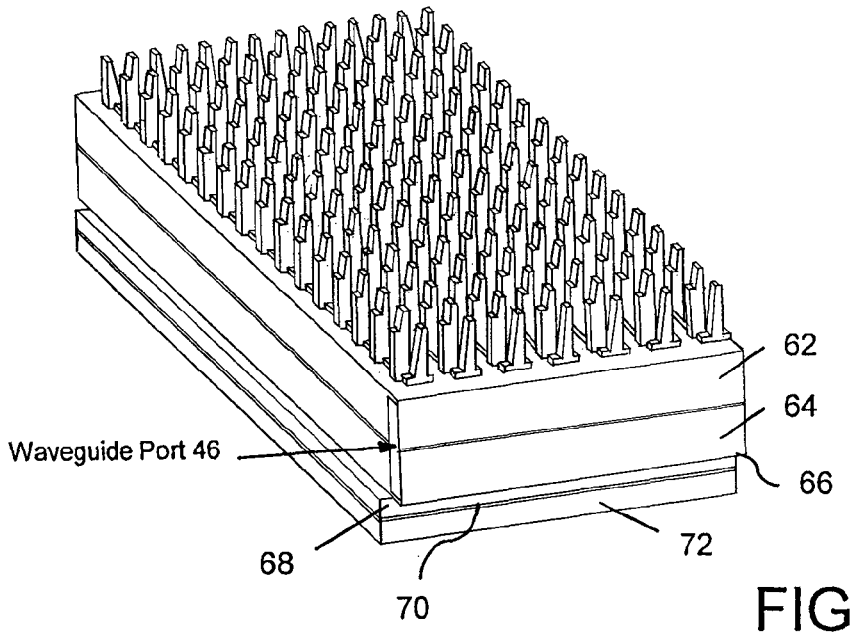
FIG. 8 is a perspective view of a 7-by-16 ESA antenna according to an exemplary embodiment of the present invention.
Figure 9:
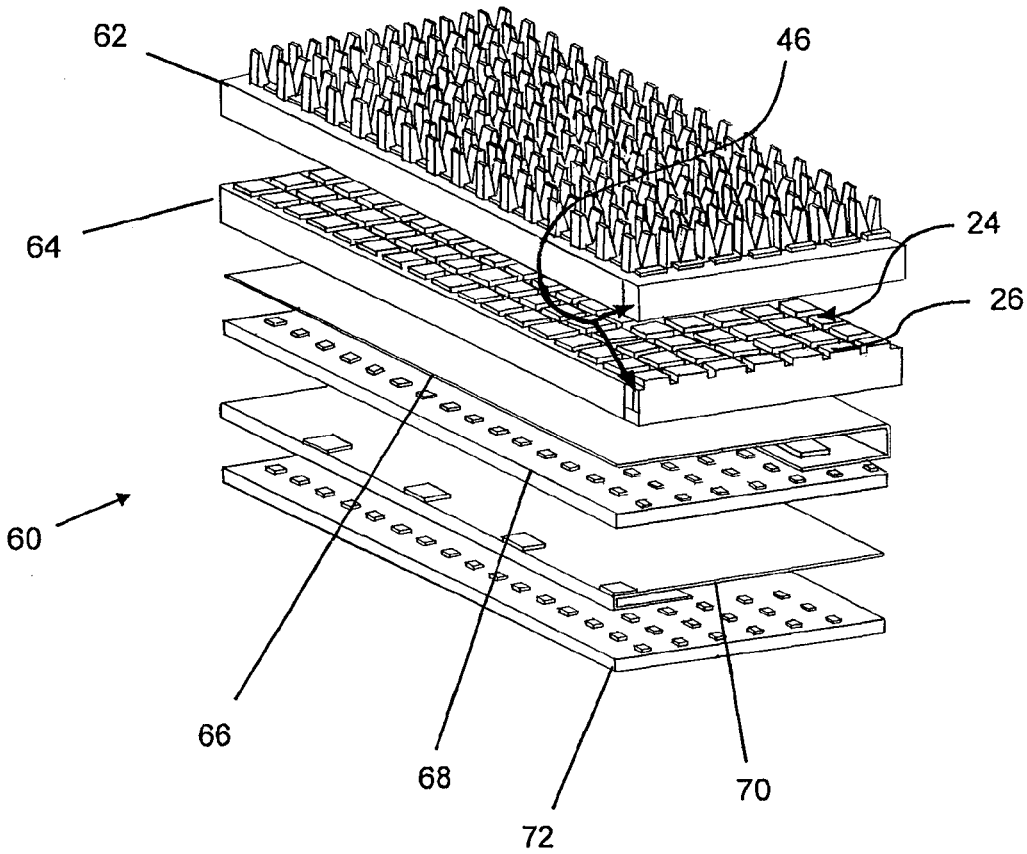
FIG. 9 is an exploded view of the antenna of FIG. 8 in accordance with an exemplary embodiment of the present invention.

FIGS. 8 and 9 illustrate construction of a small two-dimensional antenna 60 in accordance with an embodiment of the invention. The antenna may be constructed in a quasi-monolithic manner in which individual parts form structures for a plurality of array elements. More specifically, the antenna 60 can be made up of four metal plated injection molded plastic parts and two circuit boards. The uppermost piece 62 contains flared notch radiators and the upper half of the primary feed line 46, main lines 24 and branch lines 26. The piece 64 below contains the lower half of the primary feed line 46, main lines 24 and branch lines 26. The interface between upper and lower halves 62, 64 coincides with the centerline of the broadwall of the main lines 24. Cross-coupling holes forming the respective directional couplers 30 between the main lines and the branch lines 26 are defined between the joined halves. These upper and lower halves 62, 64 can be joined with a conductive bond after plating or plated after bonding with a non-conductive bond, for example.

Beneath the upper and lower halves 62, 64 is a Stage 1 phase shifter circuit board 66. The board 66 includes the aforementioned first stage varactor 52*a* (or other analog variable capacitance device, such as MEMS varactors or voltage variable dielectric based capacitors in film or bulk form) together with a series of digital-to-analog converters for converting digital control signals from the phase controller 36 into analog signals used to bias the varactors 52*a* in each element 22. The phase shifter circuit board 66 also may include a plurality of switches (e.g., MEMS-based or semiconductor-based switches). Beneath the circuit board 66, there is a spacer plate 68, a Stage 2 phase shifter circuit board 70 including the second stage varactors 52*a* and corresponding digital-to-analog converters (not shown), and a shorting plate 72 making up the reflecting terminal 32 of each of the elements 22. The spacer plate 68 contains an array of thru holes that have the same cross section as the branch line ridged waveguides 26. The shorting plate 72 has an array of blind ridged waveguides and is also conductively bonded to the rest of the assembly. The shorting plate forms an array of waveguide offset shorts that terminate the plurality of branch lines.

A feature of the design of FIGS. 8 and 9 is the fact that the phase shifters 52*a* and 52*b* are located behind the feed (the term feed is being used here to describe all the main lines and couplers as well as the power dividers that join the main lines) and radiators 28. Normally phase shifters in ESAs are located between the feed and the radiators. Placing the phase shifters in back greatly simplifies the problem of routing the control lines, enabling considerable cost savings. The phase shifter circuit boards 66, 70 have two thin (~0.001") dielectric layers (for example a polyimide material) and three metal layers. Plated vias connecting the outer two metal layers are provided to ensure electrical continuity between the waveguides on either side of the circuit board 66, 70. The middle metal layer is used to route the control lines to the varactors 52*a*, 52*b*. Plated vias are used to connect the varactors 52*a*, 52*b* to the control line layer. Since the circuit boards 66, 70 are very thin, the via holes can be burned in at low cost using a laser process (which can be less expensive than mechanically drilling).

As shown in FIGS. 8 and 9, the phase shifter circuit boards 66, 70 can be wrapped around the shorting plate 72 on the back of the antenna 60. For example, the boards can be formed as flexible circuit boards as are known. This enables the digital-to-analog converters to also be located on the respective circuit boards, eliminating the need for the connectors and cables that would be required to route analog voltages to each individual varactor 52*a*, 52*b*.

Figure 10:
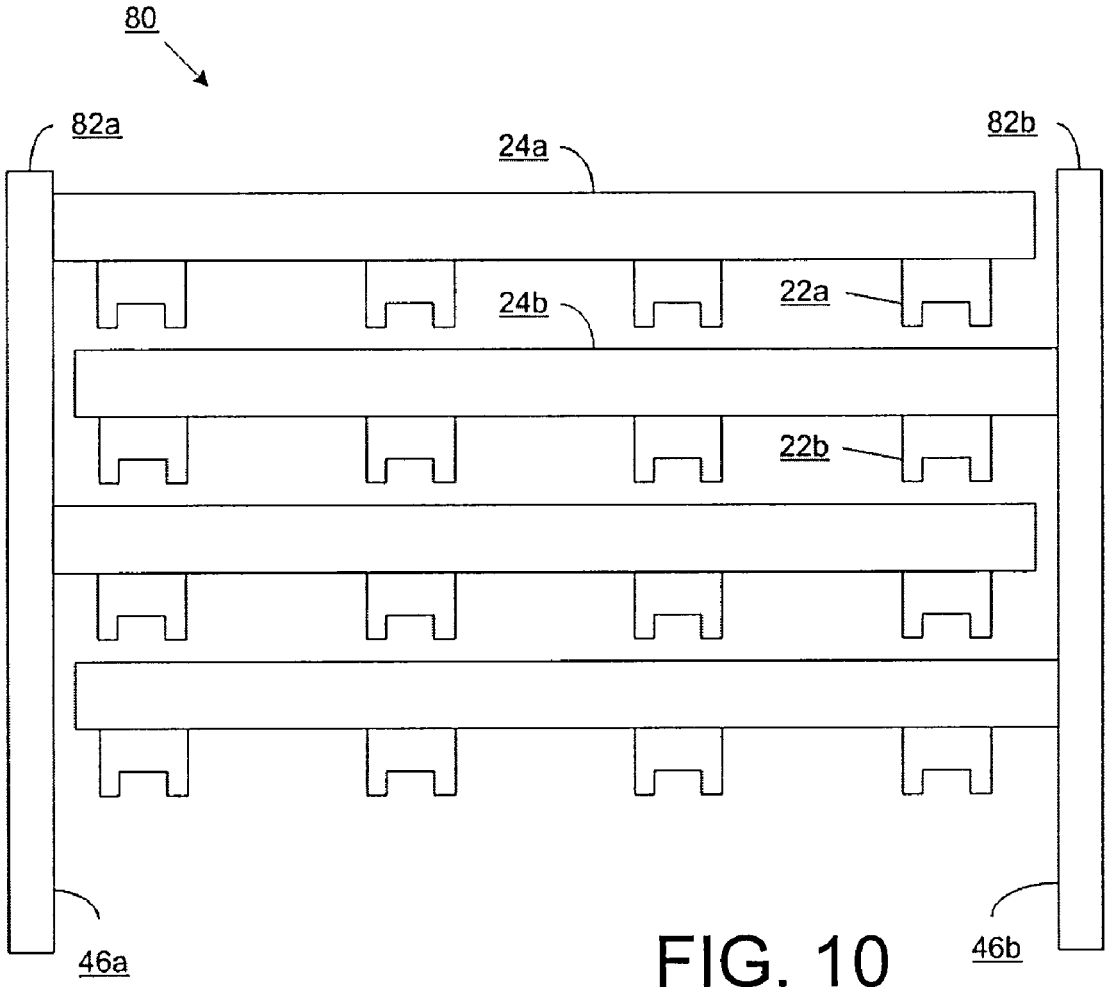
FIG. 10 is a top view of an ESA antenna in accordance with an embodiment of the present invention.

Referring now to FIG. 10, there is shown another embodiment of an antenna in accordance with the invention. The antenna 80 includes two co-located two-dimensional antenna portions or arrays 82*a* and 82*b*, wherein each array 82*a*, 82*b* includes respective main lines 24*a*, 24*b*. The main lines 24*a*, 24*b* of the respective arrays 82*a*, 82*b* are arranged in an interleaving configuration, and each main line is coupled to a corresponding primary feed line 46*a*, 46*b*. Further, each mainline 24*a*, 24*b* includes a plurality of antenna array elements 22*a*, 22*b* for transmitting and receiving signals in the same manner described above with respect to the previous embodiments. The array elements 22*a*, 22*b* may be arranged such that they are aligned with one another, as shown in FIG. 10. Alternatively, the array elements 22*a*, 22*b* may be staggered such that the array elements 22*a* of the first array 82*a* are not in line with the array elements 22*b* of the second array 82*b*.

In addition to the configuration shown in FIG. 10 in which the main lines and primary feeds of the two arrays are essentially coplanar, the main lines and/or primary feeds of one array may be located above or below the main lines and/or primary feeds of the other array, in order to facilitate achieving a sufficiently small inter-element spacing.

Different co-located arrays can be configured to operate at distinct frequency bands. For example, a first array (e.g., array 82*a* in FIG. 10) can be configured to operate at a first frequency band, and a second array (e.g., array 82*b* in FIG. 10) can be configured to operate at a second frequency band different from the first frequency band. As will be appreciated, selection of the respective frequency bands is based on the particular configuration of the respective arrays.

The ESA antenna of the present invention may be implemented in any of a variety of single or multiple array embodiments as will be appreciated. The antenna radiator elements 22 of different arrays can have orthogonal polarizations, for example. Additionally or alternatively, neighboring pairs of radiator elements of different arrays can share common dual polarization radiators and/or common dual band radiators.

Thus, the antenna in accordance with the present invention provides multi-dimensional beam agility and functionality that can only be obtained with an ESA. The antenna in accordance with the invention may utilize off-the-shelf components and very low cost manufacturing processes. Recurring costs can be very low: similar to the cost of mechanically scanned antennas, quite possibly less expensive. The design is simple and robust. Performance degrades gracefully with component failures, and therefore the design is considered to be highly reliable and enables use of low cost, low power dissipation, control electronics.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An electronically scanned array (ESA) antenna, comprising:

a main line along which an electromagnetic traveling wave may propagate; and a plurality of array elements distributed along the main line, each of the plurality of array elements comprising:

a branch line;

a directional coupler having a first port in the main line, a second port in the main line, a third port in the branch line, and a fourth port in the branch line;

a reflective termination at an end of the branch line closest to the third port of the directional coupler;

an electronically controlled phase shifter between the third port of the directional coupler and the reflective termination; and an antenna radiator at the end of the branch line closest to the fourth port of the directional coupler.

2. The antenna according to claim 1, wherein the directional coupler in each array element couples transmit electromagnetic energy from the main line to the branch line via an $S_{31}$ element of an S-matrix of the direction coupler, wherein the first through fourth ports of the directional coupler are specified by subscript values 1 through 4 of the S-matrix, respectively.

3. The antenna according to claim 2, wherein the electromagnetic energy coupled to each branch line is reflected by the phase shifter and/or reflective termination.

4. The antenna according to claim 1, wherein a majority of electromagnetic energy reflected by the phase shifter and/or reflective termination propagates through the branch line, through the directional coupler to the radiator.

5. The antenna according to claim 1, wherein a majority of electromagnetic energy received by each radiator propagates through a branch past the directional coupler and is reflected by the phase shifter and/or reflective termination.

6. The antenna according to claim 1, wherein a majority of the received electromagnetic energy reflected by the phase shifter and/or reflective termination in each branch line is coupled via an $S_{13}$ element of an S-matrix of the directional coupler to the main line.

7. The antenna according to claim 1, wherein an $S_{31}$ element of an S-matrix of each directional coupler satisfies $|S_{31}| \leqq 0.3$, where first through fourth ports of the directional coupler are specified by subscript values 1 through 4 of the S-matrix, respectively.

8. The antenna according to claim 1, further comprising a controller, wherein a radiation pattern emitted by the antenna is controllable by the controller via the phase shifters.

9. The antenna according to claim 1, wherein a magnitude of coupling provided by each of the directional couplers is varied along the main line.

10. The antenna according to claim 1, wherein the phase shifter in each array element comprises a varactor diode.

11. The antenna according to claim 10, wherein the reflective termination is a short, and the varactor diode is a shunt element in the branch line.

12. The antenna according to claim 1, wherein the phase shifters in each array element comprises a plurality of varactor diodes each shunted across a branch line.

13. The antenna according to claim 1, wherein the mainline and the branch line in each array element are waveguides.

14. The antenna according to claim 13, wherein the branch line in each array element is a ridged waveguide.

15. The antenna according to claim 1, wherein the directional coupler in each array element is a cross guide coupler.

16. The antenna according to claim 1, wherein the antenna radiator in each array element comprises an open-ended waveguide or flared notch structure.

17. The antenna according to claim 1, wherein a transmission medium for the mainline and branch lines is any one of a waveguide, microstrip, stripline, coplanar waveguide, slotline, or a combination thereof.

18. The antenna according to claim 1, comprising a plurality of main lines each with a corresponding plurality of the array elements, arranged to form a two-dimensional array.

19. The antenna according to claim 1, wherein the antenna is constructed in a quasi-monolithic manner in which individual parts comprise structures for a plurality of array elements.

20. The antenna according to claim 1, wherein the antenna has a quasi-monolithic, multi-layer construction including a first layer defining the plurality of radiators and upper halves of the plurality of mainlines, directional couplers, and branch lines, a second layer comprising lower halves of the plurality of mainlines, directional couplers, and branch lines, and a third layer comprising an array of waveguide offset shorts that terminate the plurality of branch lines.

21. The antenna according to claim 20, wherein one or more circuit boards are sandwiched between the second and third layers so as to realize phase shifters within each branch line.

22. The antenna according to claim 21, wherein the one or more circuit boards are flexible circuit boards.

23. The antenna according to claim 22, wherein the one or more circuit boards are at least partially wrapped around the third layer.

24. The antenna according to claim 20, further comprising one or more spacer layers between the second and third layers.

25. The antenna according to claim 24, wherein each spacer layer comprises an array of waveguide shims.

26. The antenna according to claim 1, wherein the phase shifters comprise analog variable capacitance devices.

27. The antenna according to claim 26, wherein the analog variable capacitance devices comprise at least one of MEMS varactors, varactor diodes or voltage variable dielectric based capacitors.

28. The antenna according to claim 1, wherein the phase shifters comprise MEMS-based or semiconductor-based switches.

29. The antenna according to claim 1, wherein the phase shifters are ferrite-based phase shifters.

30. The antenna according to claim 1, wherein the phase shifters comprise voltage variable dielectric materials in either film or bulk form.

31. The antenna according to claim 1, wherein lengths and/or dispersion of the branch lines are variable so as to alter the instantaneous bandwidth of the antenna.

32. The antenna according to claim 1, comprising two arrays of main lines each with a corresponding plurality of the array elements, said main lines arranged such that array elements of the respective main lines are interleaved to form two co-located two-dimensional arrays.

33. The antenna according to claim 32, wherein the radiator elements of the two arrays have orthogonal polarizations.

34. The antenna according to claim 32, wherein neighboring pairs of elements of the two arrays share common dual band radiators.

35. The antenna according to claim 32, wherein the two arrays are configured to operate at distinct frequency bands.

36. The antenna according to claim 1, comprising two arrays of main lines each with a corresponding plurality of branch lines and phase shifters, said main lines arranged such that branch lines of the respective main lines are interleaved to form two co-located two-dimensional arrays.

37. The antenna according to claim 36, wherein neighboring pairs of elements of the two arrays share common dual polarization radiators.

38. The antenna according to claim 1, wherein the antenna comprises injection molded or cast parts.

39. The antenna according to claim 1, further comprising at least one of a flared notch, open ended waveguide or patch radiator structure.

* * * * *